US008445421B2

(12) United States Patent
Blyth et al.

(10) Patent No.: US 8,445,421 B2
(45) Date of Patent: May 21, 2013

(54) SOLID DETERGENT COMPOSITION COMPRISING BETA CYCLODEXTRIN

(75) Inventors: Kevin Graham Blyth, Tyne and Wear (GB); Sarah Jane Douglas, Newcastle upon Tyne (GB); Alan Thomas Brooker, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 13/085,817

(22) Filed: Apr. 13, 2011

(65) Prior Publication Data

US 2011/0257061 A1 Oct. 20, 2011

(30) Foreign Application Priority Data

Apr. 19, 2010 (EP) ..... 10160344

(51) Int. Cl.

| | |
|---|---|
| ***C11D 17/06*** | (2006.01) |
| ***C11D 1/65*** | (2006.01) |
| ***C11D 3/10*** | (2006.01) |
| ***C11D 3/37*** | (2006.01) |
| ***C11D 3/50*** | (2006.01) |
| ***C11D 3/60*** | (2006.01) |

(52) U.S. Cl.
USPC ..... 510/276; 510/302; 510/376; 510/400; 510/470; 510/499; 510/507

(58) Field of Classification Search
USPC ..... 510/276, 302, 349, 376, 400, 470, 510/499, 507
See application file for complete search history.

(56) References Cited

U.S. PATENT DOCUMENTS

| | | | | |
|---|---|---|---|---|
| 5,236,615 | A * | 8/1993 | Trinh et al. | 510/349 |
| 6,143,707 | A * | 11/2000 | Trinh et al. | 510/220 |
| 6,482,789 | B1 * | 11/2002 | Kvietok et al. | 510/357 |
| 2003/0064899 | A1 * | 4/2003 | Bettiol et al. | 510/101 |
| 2003/0211960 | A1 * | 11/2003 | Smets | 510/445 |
| 2004/0192568 | A1 * | 9/2004 | Yates et al. | 510/276 |
| 2006/0128594 | A1 * | 6/2006 | Yates et al. | 510/445 |
| 2006/0189506 | A1 * | 8/2006 | Muller et al. | 510/446 |
| 2006/0223725 | A1 * | 10/2006 | Meli et al. | 510/101 |
| 2008/0045435 | A1 * | 2/2008 | Somerville Roberts et al. | 510/446 |

FOREIGN PATENT DOCUMENTS

| | | | |
|---|---|---|---|
| DE | 3020269 | B1 | 1/1981 |
| EP | 0859047 | A2 | 8/1998 |
| EP | 0971021 | A1 | 1/2000 |
| EP | 1462512 | A1 | 9/2004 |
| GB | 2311296 | A * | 9/1997 |
| WO | WO03/033636 | A1 | 4/2003 |
| WO | WO2004/085589 | A1 | 10/2004 |

OTHER PUBLICATIONS

International Search Report and Written Opinion from the International Searching Authority, mailed on Jul. 22, 2011, International Application No. PCT/US2011/032873, 11 pages.

* cited by examiner

*Primary Examiner* — Lorna M Douyon
(74) *Attorney, Agent, or Firm* — Tiffany M Zerby

(57) ABSTRACT

A solid detergent composition including: (a) detersive surfactant; (b) beta cyclodextrin; (c) essentially free from zeolite builder; (d) essentially free from phosphate builder; (e) optionally, essentially free from silicate; and (f) optionally perfume; and (g) optionally, additional detergent ingredients.

12 Claims, No Drawings

SOLID DETERGENT COMPOSITION COMPRISING BETA CYCLODEXTRIN

FIELD OF THE INVENTION

The present invention relates to solid detergent compositions comprising beta cyclodextrin. The compositions exhibit an excellent freshness profile.

BACKGROUND OF THE INVENTION

Consumers of laundry detergent products desire not only clean clothes from their laundry products, but also fresh clothes. They especially desire excellent freshness the first time they wear or use a fabric after it has been laundered. There remains a need to improve the freshness profile of laundry detergent compositions. Typically, detergent manufactures have developed sophisticated perfume technology to achieve this improved freshness. However, the development of a perfume technology to improve freshness can limit the breadth of perfume palate available to the detergent manufacturer. For example, when a perfume system is designed to deliver improved freshness, the product fragrance is constrained by the choice of compatible perfume raw materials; i.e. the flexibility of the detergent manufacturer to deliver improved freshness profile and broad product fragrances is constrained.

The Inventors have found that the freshness profile can be improved by the use of beta cyclodextrin. The Inventors have found that beta cyclodextrin when incorporated into a low built laundry detergent composition improve the freshness profile of the detergent composition. The Inventors have designed a freshness delivery system that not only improves the freshness profile of the laundry detergent composition but also enables a wide variety of perfumes to be incorporated into the laundry detergent, which in turn enables the detergent manufacturer to choose the product fragrance from broad perfume palate.

SUMMARY OF THE INVENTION

The present invention provides a solid detergent composition comprising:

a. detersive surfactant;
b. beta cyclodextrin;
c. essentially free from zeolite builder;
d. essentially free from phosphate builder;
e. optionally, essentially free from silicate salt;
f. optionally, perfume; and
g. optionally, additional detergent ingredients.

DETAILED DESCRIPTION OF THE INVENTION

Solid Laundry Detergent Composition

The solid laundry detergent composition typically comprises: (a) detersive surfactant; (b) beta cyclodextrin; (c) from 0 wt % to less than 5 wt % zeolite builder; (d) from 0 wt % to less than 5 wt % phosphate builder; (e) optionally, from 0 wt % to less than 10 wt % silicate salt; and (f) optionally, additional detergent ingredients.

The composition can be any suitable form, including free-flowing particulate form, or a unit dose form including tablet form, detergent sheet form. The composition may in the form of a pouch, for example the particles or tablet may be at least partially, preferably completely, enclosed by a film, preferably a water-soluble and/or water-dispersible film. A preferred film is a polyvinyl alcohol film.

Preferred additional detergent ingredients include: bleach including bleach catalysts; hueing agents; perfume including perfume microcapsules, starch encapsulated perfume accords, and schiff's base reaction products of polyamine with perfume ketones; fabric softening agents including clay, silicones, and quaternary ammonium fabric softening agents; cationic polymers; alkoxylated polyamines; and fabric-deposition aids including cationic hydroxyethyl cellulose. These preferred ingredients are described in more detail below.

Highly preferably, the composition is a laundry detergent composition. However, the composition may be a dishwashing detergent composition including automatic dishwashing detergent composition, or a hard surface cleaner.

Typically, the solid laundry detergent composition is a fully formulated laundry detergent composition, not a portion thereof such as a spray-drying or agglomerate particle that only forms part of the laundry detergent composition. Typically, the solid laundry detergent composition comprises a plurality of chemically different particles, such as spray-dried base detergent particles and/or agglomerate base detergent particles and/or extrudate base detergent particles, in combination with one or more, typically two or more, or three or more, or four or more, or five or more, or six or more, or even ten or more particles selected from: surfactant particles, including surfactant agglomerates, surfactant extrudates, surfactant needles, surfactant noodles, surfactant flakes; builder particles, such as sodium carbonate and sodium silicate particles, phosphate particles, zeolite particles, silicate salt particles, carbonate salt particles; polymer particles such as cellulosic polymer particles, polyester particles, polyamine particles, terephthalate polymer particles, polyethylene glycol based polymer particles; aesthetic particles such as coloured noodles or needles or lamellae particles; enzyme particles such as protease prills, lipase prills, cellulase prills, amylase prills, mannanase prills, pectate lyase prills, xyloglucanase prills, and co-prills of any of these enzymes; bleach particles, such as percarbonate particles, especially coated percarbonate particles, such as percarbonate coated with carbonate salt, sulphate salt, silicate salt, borosilicate salt, or combinations thereof, perborate particles, bleach catalyst particles such as transition metal catalyst particles, or isoquinolinium bleach catalyst particles, pre-formed peracid particles, especially coated pre-formed peracid particles; filler particles such as sulphate salt particles; clay particles such as montmorillonite particles or particles of clay and silicone; flocculant particles such as polyethylene oxide particles, wax particles such as wax agglomerates, brightener particles, dye transfer inhibition particles; dye fixative particles, perfume particles such as perfume microcapsules and starch encapsulated perfume accord particles, or pro-perfume particles such as Schiff base reaction product particles, bleach activator particles such as oxybenzene sulphonate bleach activator particles and tetra acetyl ethylene diamine bleach activator particles; hueing dye particles; chelant particles such as chelant agglomerates; and any combination thereof.

Preferably, the composition comprises perfume and polyamine, wherein the perfume and polyamine are complexed with the beta-cyclodextrin. Preferably, the polyamine is Lupasol. Preferably the perfume comprises ketones and/or aldehydes.

Preferably, the beta-cyclodextrin-perfume-polyamine complex is prepared by a process comprising the steps of: (i) emulsifying perfume and polyamine to form an emulsion; and (ii) optionally heating the emulsion, typically to a temperature in the range of from 40° C. to 80° C.; (iii) preparing an aqueous solution of beta-cyclodextrin; (iv) optionally heating the aqueous beta-cyclodextrin solution to a temperature in the range of from 40° C. to 80° C.; (v) mixing the emulsion and aqueous beta-cyclodextrin solution to form a beta-cyclodextrin-perfume-polyamine mixture, preferably under conditions of high shear; (vi) removing at least some of the water from the beta-cyclodextrin-perfume-polyamine mixture to form a beta-cyclodextrin-perfume-polyamine complex.

Detersive Surfactant.

Suitable detersive surfactants include anionic detersive surfactants, non-ionic detersive surfactant, cationic detersive surfactants, zwitterionic detersive surfactants and amphoteric detersive surfactants.

Preferred anionic detersive surfactants include sulphate and sulphonate detersive surfactants.

Preferred sulphonate detersive surfactants include alkyl benzene sulphonate, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{12}$ alkyl sulphate.

Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 1 to 20, preferably from 1 to 10, preferably the alkyl alkoxylated sulphate is a $C_{8-18}$ alkyl ethoxylated sulphate having an average degree of ethoxylation of from 1 to 10, preferably from 1 to 7, more preferably from 1 to 5 and most preferably from 1 to 3.

The alkyl sulphate, alkyl alkoxylated sulphate and alkyl benzene sulphonates may be linear or branched, substituted or un-substituted.

The detersive surfactant may be a mid-chain branched detersive surfactant, preferably a mid-chain branched anionic detersive surfactant, more preferably a mid-chain branched alkyl sulphate and/or a mid-chain branched alkyl benzene sulphonate, most preferably a mid-chain branched alkyl sulphate. Preferably, the mid-chain branches are $C_{1-4}$ alkyl groups, preferably methyl and/or ethyl groups.

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, preferably having an average degree of alkoxylation of from 1 to 30; alkylpolysaccharides, preferably alkylpolyglycosides; polyhydroxy fatty acid amides; ether capped poly(oxyalkylated) alcohol surfactants; and mixtures thereof.

Preferred non-ionic detersive surfactants are alkyl polyglucoside and/or an alkyl alkoxylated alcohol.

Preferred non-ionic detersive surfactants include alkyl alkoxylated alcohols, preferably $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted.

Suitable nonionic detersive surfactants include secondary alcohol-based detersive surfactant having the formula:

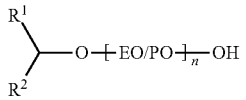

wherein $R^1$=linear or branched, substituted or unsubstituted, saturated or unsaturated $C_{2-8}$ alkyl;

wherein $R^2$=linear or branched, substituted or unsubstituted, saturated or unsaturated $C_{2-8}$ alkyl, wherein the total number of carbon atoms present in $R^1+R^2$ moieties is in the range of from 7 to 13;

wherein EO/PO are alkoxy moieties selected from ethoxy, propoxy, or mixtures thereof, preferably the EO/PO alkoxyl moieties are in random or block configuration;

wherein n is the average degree of alkoxylation and is in the range of from 4 to 10.

Suitable cationic detersive surfactants include alkyl pyridinium compounds, alkyl quaternary ammonium compounds, alkyl quaternary phosphonium compounds, alkyl ternary sulphonium compounds, and mixtures thereof.

Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zeolite Builder.

The composition comprises from 0 wt % to 5 wt % zeolite builder, preferably to 4 wt %, or to 3 wt %, or to 2 wt %, or even to 1 wt % zeolite builder. The composition may even be substantially free of zeolite builder; substantially free means "no deliberately added". Typical zeolite builders include zeolite A, zeolite P and zeolite MAP.

Phosphate Builder.

The composition comprises from 0 wt % to 5 wt % phosphate builder, preferably to 4 wt %, or to 3 wt %, or to 2 wt %, or even to 1 wt % phosphate builder. The composition may even be substantially free of phosphate builder; substantially free means "no deliberately added". A typical phosphate builder is sodium tri-polyphosphate.

Silicate Salt.

The composition may preferably comprise from 0 wt % to less than 10 wt % silicate salt, preferably to 9 wt %, or to 8 wt %, or to 7 wt %, or to 6 wt %, or to 5 wt %, or to 4 wt %, or to 3 wt %, or even to 2 wt %, and preferably from above 0 wt %, or from 0.5 wt %, or even from 1 wt % silicate salt. A preferred silicate salt is sodium silicate.

Bleach.

The composition preferably comprises bleach, preferably from 0 wt % to 10 wt % bleach.

wherein the composition comprises from 0 wt % to 10 wt % bleach, preferably to 9 wt %, or to 8 wt %, or to 7 wt %, or to 6 wt %, or to 5 wt %, or to 4 wt %, or to 3 wt %, or even to 2 wt %, and preferably from above 0 wt %, or from 0.5 wt %, or even from 1 wt % bleach. Suitable bleach includes a source of hydrogen peroxide, typically in combination with a bleach activator and/or a bleach catalyst.

Preferred source of hydrogen peroxide includes percarbonate and/or perborate salts, more preferably sodium percarbonate, sodium perborate monohydrate, and/or sodium perborate tetrahydrate. Preferably, the source of hydrogen peroxide, especially percarbonate salt, is coated. Preferred coating materials are carbonate salts, sulphate salts, silicate salts including borosilicate salts, and mixtures thereof. Another suitable source of hydrogen peroxide is pre-formed peracid. Preferably the pre-formed peracid is coated or encapsulated.

Preferred bleach activators include: tetraacetylthylene diamine (TAED); oxybenzene sulphonate (OBS) preferably nonanoyl oxybenzene sulphonate; nitrile quats, and mixtures thereof.

Preferred bleach catalysts include: imine bleach boosters, preferably oxaziridinium bleach boosters; transition metal catalysts, bleaching enzymes; and mixtures thereof.

Hueing Agent.

Hueing dyes are formulated to deposit onto fabrics from the wash liquor so as to improve fabric whiteness perception. Preferably the hueing agent dye is blue or violet. It is preferred that the shading dye(s) have a peak absorption wavelength of from 550 nm to 650 nm, preferably from 570 nm to 630 nm. A combination of dyes which together have the visual effect on the human eye as a single dye having a peak absorption wavelength on polyester of from 550 nm to 650 nm, preferably from 570 nm to 630 nm. This may be provided for example by mixing a red and green-blue dye to yield a blue or violet shade.

Dyes are coloured organic molecules which are soluble in aqueous media that contain surfactants. Dyes are described in 'Industrial Dyes', Wiley VCH 2002, K. Hunger (editor). Dyes are listed in the Color Index International published by Society of Dyers and Colourists and the American Association of Textile Chemists and Colorists. Dyes are preferably selected from the classes of basic, acid, hydrophobic, direct and polymeric dyes, and dye-conjugates. Those skilled in the art of detergent formulation are able to select suitable hueing dyes from these publications. Polymeric hueing dyes are commercially available, for example from Milliken, Spartanburg, S.C., USA.

Examples of suitable dyes are direct violet 7, direct violet 9, direct violet 11, direct violet 26, direct violet 31, direct violet 35, direct violet 40, direct violet 41, direct violet 51, direct violet 66, direct violet 99, acid violet 50, acid blue 9, acid violet 17, acid black 1, acid red 17, acid blue 29, solvent violet 13, disperse violet 27 disperse violet 26, disperse violet 28, disperse violet 63 and disperse violet 77, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141, thiazolium dyes, reactive blue 19, reactive blue 163, reactive blue 182, reactive blue 96, Liquitint® Violet CT (Milliken, Spartanburg, USA) and Azo-CM-Cellulose (Megazyme, Bray, Republic of Ireland).

Perfume Microcapsule.

Preferably, the composition comprises a perfume microcapsule. Preferred perfume microcapsules comprise melamine formaldehyde, urea formaldehyde, urea, or mixtures thereof.

Starch Encapsulated Perfume Accord.

Preferably, the composition comprises a starch encapsulated perfume accord.

Hydrophobic Perfume.

Suitable hydrophobic perfume molecules typically have a boiling point of less than 250° C., preferably less than 220° C., even preferably less than 200° C. The boiling points of many perfume ingredients are given in: "Perfume and Flavor Chemicals (Aroma Chemicals)," Steffen Arctander, published by the author, 1969.

Suitable hydrophobic perfume molecules typically have a clogP value of greater than 2, preferably greater than 3, more preferably greater than 4, or even greater than 5. The clog P value is a measurement of the octanol/water partition coefficient of the perfume molecule and is the ratio between its equilibrium concentrations in octanol and in water. Since the partition coefficients of the preferred perfume ingredients of this invention have high values, they are more conveniently given in the form of their logarithm to the base 10, logP, which is known as the clogP value. The clogP value of many perfume ingredients has been reported; for example, the Pomona92 database, available from Daylight Chemical Information Systems, Inc. (Daylight CIS), Irvine, Calif., contains many, along with citations to the original literature. However, the clogP values can also be calculated by the "CLOGP" program, available from Daylight CIS. The "clogP value" is typically determined by the fragment approach of Hansch and Leo: c.f. A. Leo, in Comprehensive Medicinal Chemistry, Vol. 4, C. Hansch, P. G. Sammens, J. B. Taylor and C. A. Ramsden, Eds., p. 295, Pergamon Press, 1990.

Suitable hydrophobic perfume molecules typically have an Odour Detection Threshold (ODT) of less than 50 parts per billion (ppb), preferably less than 10 ppb. The ODT is described above in more detail.

Preferred hydrophobic perfume molecules are selected from the group consisting of: ethyl 2 methyl butyrate, 4 acetate for acetate, linalool, ethyl 2 methyl pentanoate, tetra hydro linalool, c is 3 hexenyl acetate, c is 3 hexanol, cyclal C, and mixtures thereof.

Polyamine Perfume System.

Preferably, the composition comprises a polyamine perfume system. Preferably the polyamine perfume system comprises a polyamine and perfume, preferably the perfume comprises aldehydes and/or ketones, most preferably ketone. Preferably, the polyamine perfume system comprises a Schiff's base reaction product of polyamine with perfume ketone and/or aldehyde, preferably the perfume ketone. A preferred polyamine is Lupasol. A preferred perfume ketone is delta-damascone.

Fabric Softening Agent.

The composition may comprise a fabric-softening agent. Preferably, the fabric softening agent is selected from clay, preferred clays are montmorilloniet clay; silicone, a preferred silicone is polydimethyl siloxane (PDMS); quaternary ammonium fabric softening compounds; and mixtures thereof. A highly preferred fabric softening agent is a combination of clay, especially montmorillonite clay, with silicone, especially PDMS.

The composition may also comprise a flocculating agent in combination with the fabric-softening agent. A preferred flocculating agent is polyethylene oxide (PEO). PEO is especially preferred when used in combination with clay, especially montmorillonite clay.

Cationic Polymer.

The composition may comprise a cationic polymer. Preferred cationic polymers include: cationic silicones; cationic cellulose, especially cationic hydroxyethyl cellulose; cationic polyamines; and mixtures thereof.

Alkoxylated Polyamine.

The composition may comprise an alkoxylated polyamine.

Fabric-Deposition Aid.

The composition may comprise fabric deposition aid. Suitable fabric-deposition aids are polysaccharides, preferably cellulosic polymers. Other suitable fabric-deposition aids include poly diallyl dimethyl ammonium halides (DADMAC), and co-polymers of DADMAC with vinyl pyrrolidone, acrylamides, imidazoles, imidazolinium halides, and mixtures thereof, in random or block configuration. Other suitable fabric-deposition aids include cationic guar gum, cationic cellulose such as cationic hydroxyethyl cellulose, cationic starch, cationic polyacylamides, and mixtures thereof.

Additional Detergent Ingredients.

The composition typically comprises other detergent ingredients. Suitable detergent ingredients include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6 R and 2.0 R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

EXAMPLES

Example 1

Example of Beta-Cyclodextrin Particle Preparation

Polymer (Lupasol WF 11.00 g) is heated in a water bath to 60° C. before addition to de-ionised water (270 g also at 60° C.) in a plastic beaker. The polymer and water are combined using a Silverson high shear mixer (L4RT) at 4000 rpm for 5 minutes.

Beta-Cyclodextrin (200.00 g) is then added with stirring at 3000 rpm over 10 minutes followed by further mixing at 3500 rpm for 10 minutes. Perfume accord (20 g) is then added with stirring at 3500 rpm for 5 minutes ensuring no perfume oil remains on the surface.

The resulting preparation is then stirred at 3500 rpm for 5 additional minutes. Some increase in viscosity occurs. The β-Cyclodextrin complex is spread thinly onto a stainless steel tray and left to dry for 46 hours in a well ventilated area at room temperature and humidity (15 to 25° C. and <75% relative humidity). The β-Cyclodextrin complex is ground to a powdery consistency using a Kenwood mixer.

Example 2

Laundry Detergent Compositions

| Ingredient | Composition A | Composition B | Composition C | Composition D |
|---|---|---|---|---|
| Linear alkyl benzene sulphonate | 9 w % | 9 wt % | 12 wt % | 8 wt % |
| Alkyl ethoxyalted sulphate having an average degree of ethoxylation of from 0.5 to 3 | 3 wt % | 2 wt % | 1 wt % | 2 wt % |
| Cationic detersive surfactant | 0.5 wt % | 0.5 wt % | 0.5 wt % | 0.5 wt % |
| Sodium sulphate | 60 wt % | 60 wt % | 55 wt % | 60 wt % |
| Sodium carbonate | 8 wt % | 10 wt % | 5 wt % | 8 wt % |
| Beta cyclodextrin particles of example 1 | 4 wt % | 7 wt % | 8 wt % | 5 wt % |
| Oxaziridinium-based bleach catalyst | 0.005 wt % | 0.005 wt % | 0.005 wt % | 0.005 wt % |
| Sodium silicate | 3 wt % | 0 wt % | 3 wt % | 0 wt % |
| Carboxylate polymer | 2 wt % | 2 wt % | 2 wt % | 2 wt % |
| Brightener | 0.02 wt % | 0.02 wt % | 0.02 wt % | 0.02 wt % |
| Enzymes | 0.8 wt % | 0.8 wt % | 0.8 wt % | 0.8 wt % |
| Cellulosic polymer | 0.3 wt % | 0.3 wt % | 0.3 wt % | 0.3 wt % |
| Misc & Moisture | to 100 wt % | to 100 wt % | to 100 wt % | to 100 wt % |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Solid detergent composition comprising:

a. anionic surfactant;

b. beta-cyclodextrin;

c. cationic surfactant;

d. perfume; and e. polyamine;

wherein the perfume and the polyamine are complexed with the beta-cyclodextrin; and wherein the solid detergent composition is free from zeolite builder, phosphate builder, and silicate salt.

2. Solid detergent composition according to claim 1, wherein the composition comprises hydrophobic perfume, wherein the hydrophobic perfume molecules have:

(i) a boiling point of less than 250° C.; and (ii) a clogP value of greater than 2.

3. Solid detergent composition according to claim 1, wherein the composition comprises schiff's base reaction product of polyamine with perfume ketone.

4. Solid detergent composition according to claim 1, wherein the composition further comprises cationic polymer.

5. Solid detergent composition according to claim 1, wherein the composition further comprises clay and silicone.

6. Solid detergent composition according to claim 1, wherein the composition further comprises a fabric-deposition aid.

7. Solid detergent composition according to claim 1, wherein the composition further comprises alkoxylated polyamine.

8. Solid detergent composition according to claim 1, wherein the composition further comprises bleach catalyst.

9. Solid detergent composition according to claim 1, wherein the composition further comprises hueing agent.

10. Solid detergent composition according to claim 1, wherein the composition further comprises mid-chain branched detersive surfactant.

11. Solid detergent composition according to claim 1, wherein the composition is a free flowing particulate form.

12. Solid detergent composition according to claim 1, wherein the composition is a laundry detergent composition.

* * * * *